US005678701A

United States Patent [19]

Anderson

[11] Patent Number: 5,678,701

[45] Date of Patent: Oct. 21, 1997

[54] RETAIL DISPLAY UNIT

[76] Inventor: Wayne Anderson, 171 Brook Ave., Deer Park, N.Y. 11729

[21] Appl. No.: 451,406

[22] Filed: May 26, 1995

[51] Int. Cl.[6] ..... A47G 29/00; A47B 73/00

[52] U.S. Cl. ..... 211/73; 211/71; 211/74; 206/490; 220/28.83; 248/152; 248/312.1; D7/701; D9/344; D9/346; D9/517

[58] Field of Search ..... 211/71, 72, 73, 211/74; 248/146, 152, 312, 312.1; 206/145, 486, 490; 220/23.4, 23.6, 23.83; D7/701, 707; D9/341, 344, 346, 457, 517, 519, 548

[56] References Cited

U.S. PATENT DOCUMENTS

| | | | |
|---|---|---|---|
| D. 110,477 | 7/1938 | Carpenter | D9/526 |
| D. 283,980 | 5/1986 | Haswell | D9/519 X |
| 3,039,616 | 6/1962 | Proffit | 211/71 |
| 3,139,255 | 6/1964 | Palm | 248/152 X |
| 3,376,975 | 4/1968 | Brothers | 248/152 X |
| 3,602,371 | 8/1971 | Weiner et al. | 211/74 |
| 3,964,709 | 6/1976 | LaBelle et al. | 211/73 X |
| 4,187,948 | 2/1980 | Perrella | 211/71 |
| 4,515,334 | 5/1985 | Horne | 211/74 X |
| 5,031,778 | 7/1991 | Edgecombe | 211/74 X |
| 5,180,066 | 1/1993 | McArdle | 211/74 |
| 5,366,192 | 11/1994 | Carroll | 248/152 |
| 5,582,302 | 12/1996 | Kozak | 211/74 |

FOREIGN PATENT DOCUMENTS

| | | | |
|---|---|---|---|
| 8662 | 4/1896 | United Kingdom | 211/74 |

*Primary Examiner*—Carl D. Friedman
*Assistant Examiner*—Kevin D. Wilkens
*Attorney, Agent, or Firm*—Lackenbach Siegel Marzullo Aronson & Greenspan P.C.

[57] ABSTRACT

A retail display with bowls for holding and displaying weighty small parts such as steel bolts, nuts, screwdriver bits, drill bits and the like, having a base portion and an upright portion holding the bowls. The upright portion is resiliently cantilevered to the base portion such that it flexes downwardly toward the base portion under applied weight. The bowls are supported in the upright portion in such location that they gently touch or almost touch each vertically adjacent bowl, and the bottom bowl gently or almost touches the base. When a load is applied, particularly when the bowls are filled with weighty products to be displayed, the upright portion flexes downwardly until the vertically aligned bowls firmly touch each other and the bottom bowl firmly touches the base, thereby providing strong support for the weighted bowls.

10 Claims, 3 Drawing Sheets

RETAIL DISPLAY UNIT

BACKGROUND OF THE DISCLOSURE

Retail displays, particularly point of sale displays, of small but heavy parts, such as steel bolts, nails, bits, etc., are constrained by requiring strength to support a quantity of the heavy products, a small footprint to occupy the least possible space in a crowded selling area, and a visually pleasing appearance with adequate space for signage and printed graphics. Small parts in bulk have frequently been displayed and sold in transparent open bowls, much like penny candies sold in glass bowls in older drug stores and candy stores. In more recent years, bowls have been held in support racks, typically made of heavy gauge wire, so that multiple bowls can be located on a small floor or counter area. Wire racks have been limited by the weight they can economically support and by lack of modern appearance and signage or printing area.

SUMMARY OF THE INVENTION

The present invention provides a flexible stand for multiple bowls adapted for retail display of heavy products. The stand holds the bowls in at least one vertical orientation such that when the bowls are weighted with product, the stand flexes to permit the bowls in a given vertical run to come into contact with each other, with the bottom bowl contacting the base of the stand. The bowls are then directly supported by the base of the stand, providing rigid support of a strength which is limited by the strength of the bowls themselves. If the stand is made of a flexible transparent plastic, such as LUCITE, acrylic resins consisting of a series of polymeric esters of methacrylic acid, (a E.I. DUPONT DE NEMOURS TRADEMARK) or LEXAN, thermoplastic carbonate-linked polymers produced by reacting bisphenol A and phosgene a trademark of General Electric Co. for an acrylic plastic resin or a polycarbonate, respectively, the display unit displays the bowl contents and provides surface area for imprinting in a visually appealing unit.

In particular, the present invention provides a multiple-bin display unit adapted for retail sales display of small parts, comprising an easel stand having a horizontal base section and an angularly upstanding display section resiliently cantilevered thereto. The display section has a plurality of keyhole-shaped openings extending outwardly of one or more side edges thereof, each to receive the neck of an open bowl having an extended circumferential lip at its opening. The vertical spacing between the keyhole-shaped openings is such that the empty bowls lightly touch or almost touch each other. The vertical spacing between the bottom-most keyhole-shaped opening and the base section is that the empty bottom-most bowl lightly touches or almost touches the base. As small parts or other products are put into the bowls, weighing them down, the resiliency of the upstanding display section with respect to the base section causes the display section to bend downwardly until each bowl is in direct or heavier contact with the bowl next below and the bottom bowl is in direct or heavier contact with the base, thereby providing direct support for the weight of products in the bowls.

DESCRIPTION OF THE PREFERRED EMBODIMENT

Figure 1:
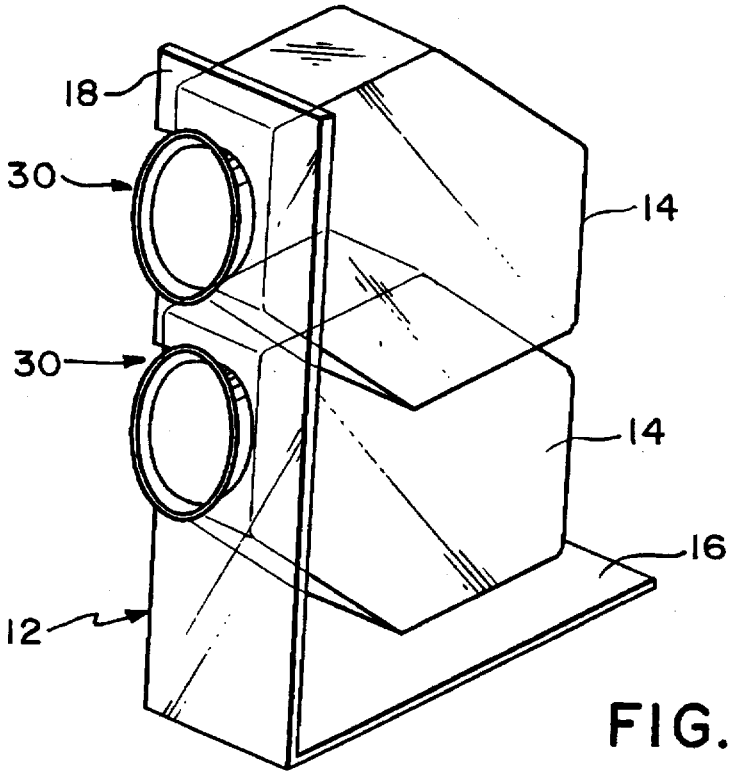
FIG. 1 is a perspective view of the retail display unit of the invention showing a single vertical row of bowls.

With reference to the drawing, retail display unit 10 of the invention comprises a display easel 12 and a plurality of open topped bowls 14.

Display easel 12 comprises a normally horizontal base portion 16 and a display portion 18 disposed angularly upstanding from base portion 16. In the preferred embodiment, display easel 12 is a unitary structure made of a transparent flexible structural material such as acrylic plastic or a polycarbonate, with display portion 18 resiliently cantilevered with respect to base portion 16. Alternatively, the base and the display portions may be separate members hingedly or otherwise flexibly joined to each other, or rigidly joined to each other but with a flexible display portion, to form the display easel.

Figure 2:
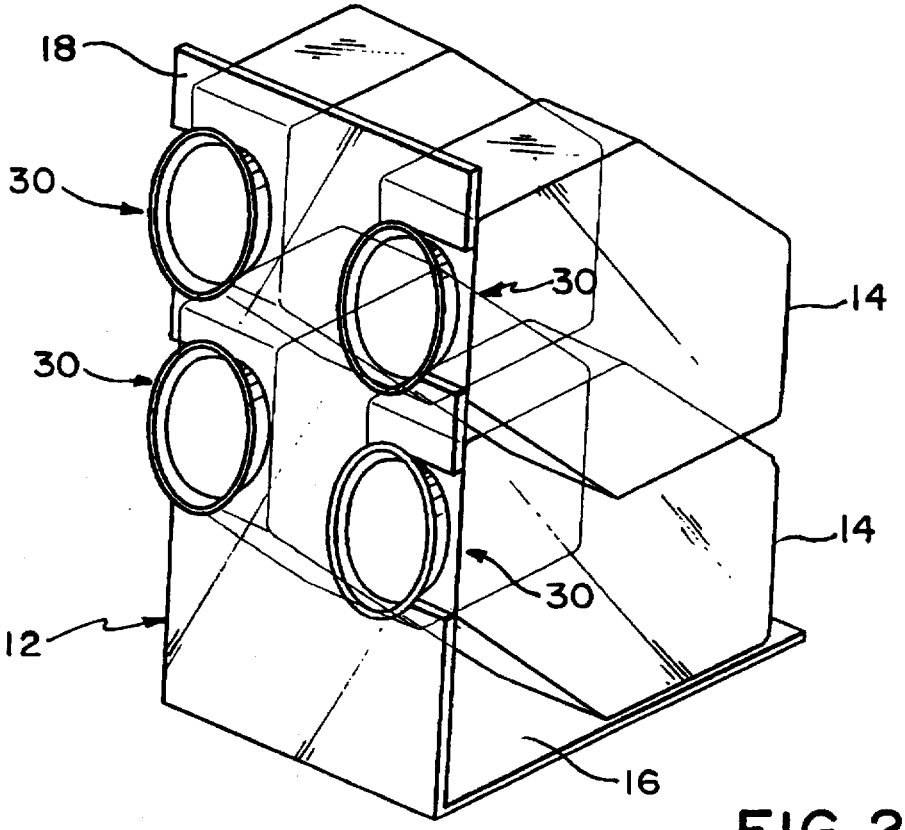
FIG. 2 is a perspective view of the retail display unit of the invention showing two vertical rows of bowls.
Figure 3:
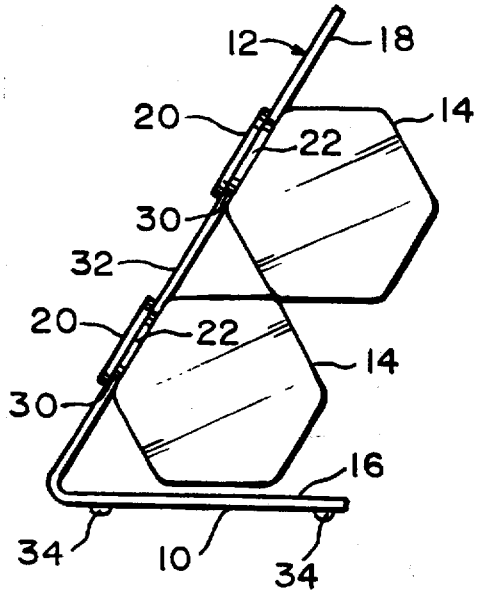
FIG. 3 is a side view of the retail display unit of the invention showing the bowls empty and the unit unloaded.
Figure 4:
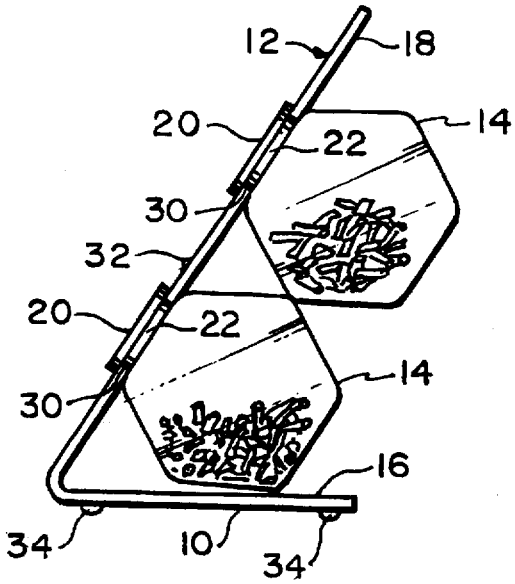
FIG. 4 is a side view of the retail display unit of the invention showing the bowls lightly filled with products for display and the unit partially loaded.

Bowls 14 are supported by display portion 18 in at least one vertical row or orientation, FIG. 1 showing a configuration with one vertical row and FIG. 2 showing a configuration with two vertical rows. Bowls 14 are commercially available, such as from CCW Products Inc. of Arvada, Colo., and have an opening formed by a circumferential lip 20 and an adjacent neck 22 having an outer diameter less than that of lip 20. Display portion 18 is provided with one circular or semi-circular mounting port 24 for each bowl 14 to be supported, as best shown in FIG. 4. Mounting port 24 is of substantially the same diameter as the diameter of neck 22, and less than the diameter of lip 20. Each mounting port 24 is open to a side edge 26 of display portion 18 by means of a slot 28 which communicates with mounting port 24. The width of slot 28 is slightly less than the diameter of mounting port 24 and the combination of a mounting hole and its communicating slot is a substantially keyhole-shaped opening 30. A bowl 14 is mounted to display portion 18 by inserting neck 22 into keyhole-shaped opening 30 until it rests in mounting port 24. By virtue of the slightly reduced width of slot 28, neck 22 snaps into mounting port 24 and is restrained from unintentionally coming out of mounting port 24. The weight of bowl 14 and its contents is supported by lip 20 resting against the face 32 of display portion 18. The flexibility of the materials utilized for display portion 18 and bowl 14 allows such action.

A plurality of keyhole-shaped openings 30 are arranged in at least one vertically disposed line at spaced distances depending on the diameters of bowls 14 such that, when unloaded and light, vertically adjacent bowls either touch each other lightly or are slightly spaced from each other.

Similarly, the vertical distance of the lowermost keyhole-shaped opening above base 16 is such that the lowermost bowl, when unloaded, lightly touches or is slightly above base 16. All such distances take into account the angular lean of the cantilever of display portion 18. As weight is added to bowls 14, resiliently cantilevered display portion 18 flexes downwardly toward base 16, bringing vertically disposed bowls 14 into contact or tight contact with each other, and brings the lowermost bowl 14 into contact or tight contact with base 16, whereby the load is now supported at least in part by the direct contact between the bowls and the base, greatly increasing the weight-carrying capacity and stability of display unit 10 of the invention.

Figure 9:
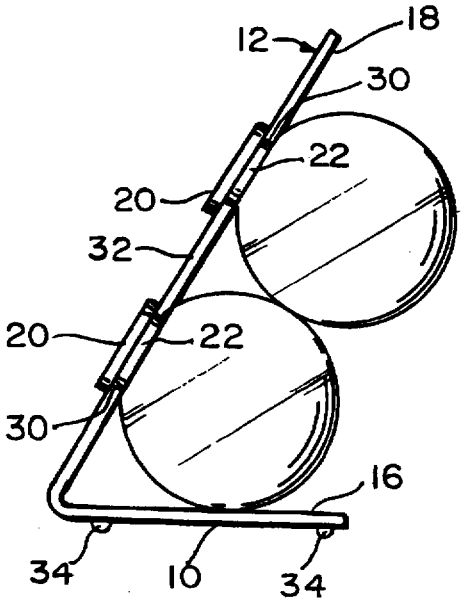
FIG. 9 is a view similar to that of FIG. 3, but showing spherical bowls.
Figure 6:
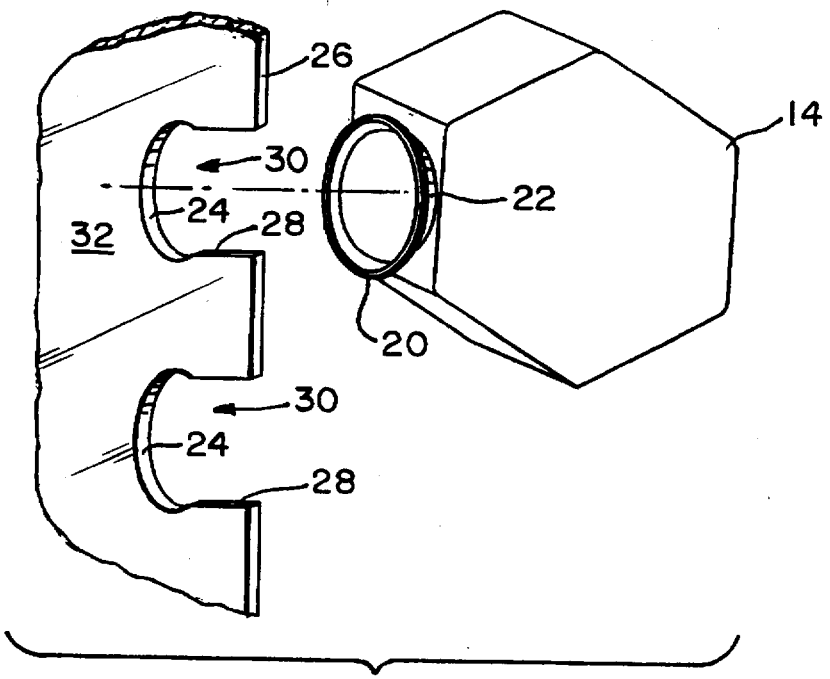
FIG. 6 is a fragmentary perspective view of a portion of the upright section of the display easel with the keyhole shaped opening and a bowl positioned for insertion into the opening.
Figure 8:
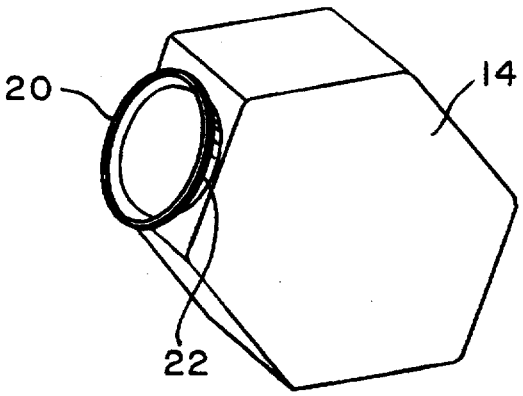
FIG. 8 is a perspective view of the bowl shown in FIG. 6.
Figure 7:
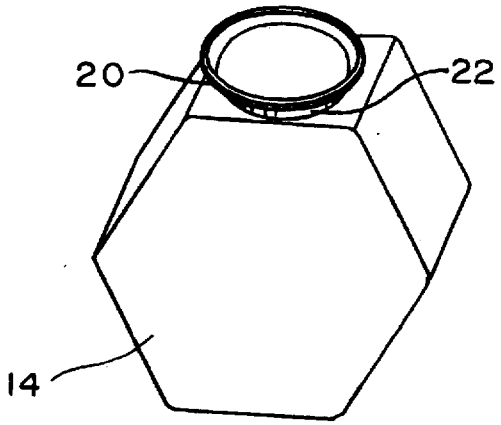
FIG. 7 is a side view of a bowl as used in the invention, showing the lip and neck at the opening thereof.

Base 16 may be provided with feet 34. Signage may be applied to display portion 18. Bowls may be polygonal or spherical, the latter being shown in FIG. 9. Bowls may be separate or may be glued or welded to each other at the line of contact to increase strength and stability.

Figure 5:
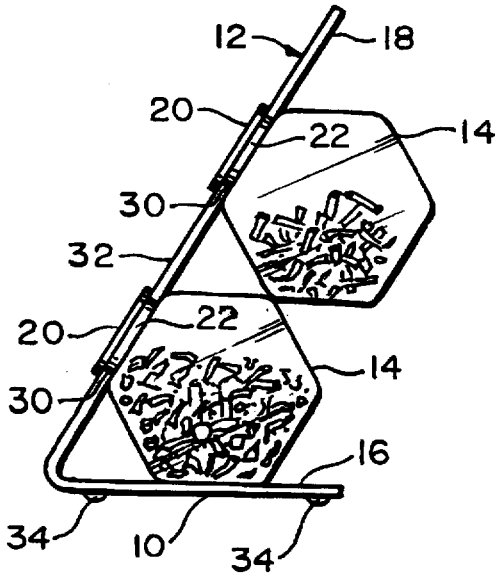
FIG. 5 is a side view of the retail display unit of the invention showing the bowls containing products for display and the unit loaded.

It would be noted that the strength of retail display unit 10, and its ability to support substantial loads in bowl 14, comes from the weight being supported by base 16 due to contact between the bowl and the base, as shown in FIG. 5. If this bowl-to-bowl-to-base contact can be achieved with lightly loaded or unloaded bowls, the objectives of the invention will have been met, but with display easel 12 and keyhole-shaped opening 30 not being precisely located with small enough tolerances to permit such contact in an unloaded condition, within the bounds of economical manufacture of the unit, typically the unloaded unit in a production configuration will, when unloaded, have some amount of space between the bowls and the base.

What is claimed is:

1. A retail display unit for displaying marketable products in multiple bowls, comprises:

a. a display easel provided with a base portion and a display portion disposed in an acute angularly upstanding relationship with respect to said base portion, b. said display portion comprising a vertical row of side-opening bowl mounting means, and c. a plurality of bowls, each terminating in a circular neck opening with a peripheral lip protruding outwardly therefrom;

d. each of said bowls normally being supported by said peripheral lip resting against said display portion one above the other in said display easel by one of said bowl mounting means, with said plurality of bowls extending between said base and display portions of said display easel; and e. said plurality of bowls when unloaded and light just about touching each other or being slightly spaced from each other; and when loaded all of said bowls touching each other with a lowermost bowl in direct, heavier contact with said base portion, thereby providing direct support for the marketable product displayed in said bowls.

2. The retail display unit in accordance with claim 1, wherein said side-opening bowl mounting means is a keyhole-shaped opening.

3. The retail display unit in accordance with claim 2, wherein said neck of each bowl resides in a hole portion of said keyhole-shaped opening upon passing through said side opening bowl mounting means, with said lip retaining each said bowl in place so as to aid in precluding a bowl from slipping out from said keyhole-shaped opening transversely of said display portion.

4. The retail display unit in accordance with claim 1 wherein:

a. said display portion is resiliently cantilevered to said base portion.

5. The retail display unit in accordance with claim 1, wherein said display portion and said base portion, at least one of which being made from a transparent element, are joined together at an acute angle, for enabling said display portion to be resiliently cantilevered.

6. The retail display unit in accordance with claim 1, wherein said display portion and said base portion are made of plastic in one integral piece.

7. The retail display unit in accordance with claim 1, wherein at least one bowl is adhesively joined to adjacent bowls along a line of contact between so as to aid in stabilizing said bowls.

8. The retail display unit in accordance with claim 1, wherein said display easel is made from a thermoplastic material selected from the group consisting of acrylic resins and polycarbonates.

9. The retail display unit in accordance with claim 1, wherein said bowls are polygonal in shape with said neck and lip being round.

10. The retail display unit in accordance with claim 1, wherein said bowls are spherical with said neck and lip being round.

* * * * *